United States Patent [19]

Vanderman

[11] Patent Number: 4,779,606

[45] Date of Patent: Oct. 25, 1988

[54] GAS BURNER

[76] Inventor: Zvi Vanderman, 11, Haknesset Street, Neve Haim, Hadera, Israel

[21] Appl. No.: 945,308

[22] Filed: Dec. 22, 1986

[30] Foreign Application Priority Data

Feb. 20, 1986 [IL] Israel ..... 77945
May 5, 1986 [IL] Israel ..... 78690

[51] Int. Cl.[4] ..... F24C 3/00

[52] U.S. Cl. ..... 126/39 E; 431/354; 239/423; 239/425.5

[58] Field of Search ..... 126/39 R, 39 E, 40, 126/214 R, 214 C, 214 D, 39 H, 39 N, 39 J, 39 K; 239/419.5, 422, 423, 424, 425.5; 431/347, 349, 354, 356, 217

[56] References Cited

U.S. PATENT DOCUMENTS 1,155,114 9/1915 Van Daam ..... 431/217
2,187,169 1/1940 Mills ..... 126/214 R
2,587,802 3/1952 Abrams ..... 431/349

FOREIGN PATENT DOCUMENTS 651713 2/1929 France ..... 126/39 J

*Primary Examiner*—Samuel Scott
*Assistant Examiner*—Noah Kamen
*Attorney, Agent, or Firm*—Steinberg & Raskin

[57] ABSTRACT

A gas burner having at least one continuous annular gas delivery nozzle in a top plate of its head. The top plate forms part of a cap-like upper member supported by a dish-like base member, the two forming between them a gas chamber. The gas chamber accommodates at least one insert plate which has a boss extending upwards into an opening of the top plate to form with the rim of the opening or with the annular boss of another insert plate an annular gas delivery nozzle.

20 Claims, 6 Drawing Sheets

GAS BURNER

BACKGROUND OF INVENTION

The present invention concerns gas burners of the kind that are used, for example, in cooking stoves. In the following specification the invention will be described with reference to gas burners for cooking stoves, it being understood that it is not confined thereto and that the gas burners according to the invention may also be installed in other appliances that use gas burners, such as, for example, heating stoves for various domestic and industrial applications.

More specifically the invention is concerned with the design of the head section of a gas burner, i.e. the section at which a flame is produced by combustion of a gas/air mixture. In the following specification and claims the head section of a gas burner will at times be referred to for short as "head".

Conventional gas burner heads comprise a single piece upper circular plate resting on a dish-shaped base in such a way that a gas chamber is formed between the plate and base, means being provided for supplying a pressurized gas/air mixture to the gas chamber. The rim of the upper plate comprises in even distribution a plurality of radially extending orifices or nozzles (hereinafter "nozzles") which serve for the ejection of a gas/air mixture for combustion. In this manner a circumferential flame is formed around the head, consisting of a plurality of discrete, conically shaped flames each associated with one of the nozzles.

This conventional arrangement has a number of drawbacks. Thus, upon ejection of the pressurized gas/air mixture through the nozzles, the gas jet emerging from each nozzle produces around it a zone of reduced pressure whereby ambient air is sucked into the mixture with the consequence that the gas/air mixture fed to the flame for combustion is richer in air than the mixture delivered to the gas chamber. It may accordingly happen that the burning gas/air mixture comprises an excessively high proportion of air which may result in inefficient combustion and produce flames of relatively low temperatures.

For proper functioning, the gas/air mixture delivered for combustion must be prepared in the gas chamber by heat emanating from the burner's top. In known gas burners in which the radially extending nozzles are at a level somewhat below the top, such preheating is hampered by a stagnant pocket of hot gas/air mixture accumulating between the nozzles and the top and functioning as an insulator. In consequence direct contact between the burner's top acting as heat source and the through-flowing gas/air mixture is obstructed and preheating thereof is ineffective. Such ineffective preheating is a further contributing factor to inefficient combustion in prior art gas burners.

Yet another drawback of the conventional head design of gas burners is insufficient heat transfer from the flame to the vessel that is being heated. This is so because the circumferential flame produced by conventional gas burners engulfs the vessel and in consequence there is no or only insufficient direct contact between the flame and the bottom of the vessel and moreover a significant part of the heat from the engulfing flame is dissipated and lost to the ambient atmosphere.

Yet another disadvantage of the conventional head design is the fact that if the contents of the vessel that is being heated spills over, the spilt over matter comes in direct contact with the nozzles and clogs them. The cleaning of clogged nozzles is a tedious operation requiring a series of manipulations which is yet another disadvantage.

Still a further disadvantage is due to the very fact that the flame in conventional burner heads consists of a plurality of discrete flames each associated with one nozzle, since when one such flame becomes extinct, for example in consequence of an air current, it is not always re-kindled. It may thus happen that in consequence of an air current part of the individual flames are extinguished with noncombusted gas continuing to stream out of the nozzles, which obviously is an undesired phenomenon.

It is the object of the present invention to provide a new kind of gas burner head free of the disadvantages of the prior art.

SUMMARY OF THE INVENTION

In accordance with the present invention there is provided a gas burner comprising:

- a cap-like upper member having a skirt and a top plate with an opening therein;
- a dish-like base member supporting said upper members;
- a gas chamber confined between said upper and base members;
- at least one insert plate inside the gas chamber extending in parallel to and at a distance from the top plate of said upper member and having an integral boss extending into the opening in the top plate of said upper member so as to form either with said opening or with a concentric boss of another insert plate a continuous annular slot serving as gas delivery nozzle; and
- means for supplying a gas/air mixture into said gas chamber.

The boss of said insert plate may be cylindrical or of any other suitable axisymmetrical shape.

In accordance with one embodiment of the invention the gas burner comprises a single insert plate detachably suspended from the inner wall of the cap-like upper member and having ports for the passage of gas therethrough.

In accordance with another embodiment of the invention the gas burner comprises a single insert plate detachably mounted around a central post of the burner and being of a smaller size than said cap-like upper member whereby the plate's rim remains clear of the upper member thereby to form inside the gas chamber a tortuous passageway for the gas/air mixture arriving from said gas supply means.

In accordance with a further embodiment of the invention the gas burner comprises at least two concentric insert plates the innermost of which is detachably mounted around a central post of the burner, all of which plates are of smaller size than said cap-like upper member whereby the rims of all plates remain clear of the upper member thereby to form inside the gas chamber a tortuous passageway for the gas/air mixture arriving from said gas supply means, each of the second and any further insert plate having an annular boss adapted to be surrounded by the boss of the insert plate next below at a distance therefrom so as to form an annular nozzle between the two, whereby a plurality of concentric annular nozzles is formed, each of said second and any further insert plate resting on the one below, spacer means being provided for keeping the individual insert plates spaced from each other.

The provision of a plurality of concentric annular nozzles in accordance with the above embodiment is useful where large sized vessels have to be heated, e.g. in large kitchens for public use such as in hotels, army camps, hospitals and the like, and also for various industrial applications.

In accordance with embodiments of the invention in which a single insert plate or the innermost of two or more concentric plates is mounted around a central post of the burner, such plate may be suspended from the post.

In accordance with another modification of embodiments of the invention in which a single insert plate or the innermost of two or more concentric insert plates is mounted around a central post of the burner, such plate is mounted around the post in such a manner as to leave a tubular passageway between them, means being provided for supporting the plate on said base member.

In the last-mentioned modification the said tubular passageway serves as an additional innermost delivery nozzle.

If desired, the post around which an insert plate is mounted in accordance with some embodiments of the invention as specified, may be tubular and accommodate an electric ignition device adapted to produce sparks near the outer face of the top plate of the said upper member. Where in such an embodiment the insert plate is suspended from the post, it will comprise a central bore in alignment with the tubular post.

In accordance with a preferred embodiment of the invention said means for supplying a gas/air mixture into the gas chamber comprises a tubular intake chamber coaxial with said gas chamber, and pipe means adapted to deliver a gas/air mixture into said intake chamber in tangential flow.

If desired, the heat transfer surfaces of the insert plate may be increased by producing thereon protrusions and/or depressions, e.g. by way of radial or annular ribs or grooves.

The annular nozzle or nozzles in a gas burner according to the invention may have various shapes such as polygonal, oval or circular.

In a head of a gas burner according to the invention the insert plate serves as heat exchanger for preheating the gas/air mixture. As distinct from the prior art the ejection of the gas/air mixture occurs here at the top of the burner so that no stagnant pocket of a gas/air mixture is formed and the mixture flowing through the gas chamber comes unobtructedly in direct contact with both the insert plate and the top plate or the cap-like upper member. During such direct contact between the gas/air mixture and the heat donor surfaces, there occurs a smooth heat transfer by conduction and consequently the gas/air mixture flowing through the gas chamber is adequately preheated.

Furthermore, the flame produced by a gas burner head according to the invention is removed from the rim portion of the head and is accordingly located entirely underneath the bottom of the vessel that is being heated. In consequence, the gas/air mixture ejected through the annular nozzle does not attract any significant amount of additional air and the composition of the gas/air mixture that is being combusted is accordingly essentially the same as emerges out of the nozzle. Consequently, by suitable adjustment of the composition of the gas/air mixture delivered to the gas chamber the combustion is optimized.

The fact that the flame in a burner according to the invention is located entirely underneath the bottom of the vessel that is being heated also ensures an optimization of heat transfer to the vessel and a minimization of the heat that is being lost to the ambient atmosphere.

As distinct from flames in conventional gas burners which, as specified, consist of a plurality of discrete flames each associated with one nozzle, the flame produced by a gas burner according to the invention is continuous. In consequence the flame will not be extinguished even by a relatively strong air current.

Where the contents of the vessel that is being heated spills over, the spilt over matter will, as a rule, not reach the annular nozzle of the gas burner according to the invention so that the flame will continue to burn even under such circumstances.

As the annular nozzle in a gas burner head according to the invention is formed ad hoc upon assembly of the cap-like upper member and the insert, cleaning is an extremely simple manner and is achieved by simply taking the constituent component apart. This is a great improvement over prior art burners, where the individual orifices or nozzles are bored into the rim section of the upper plate so that the cleaning thereof is a tedious operation.

The invention also provides a gas stove having at least one gas burner of the kind specified.

Still further, the invention provides for use with a gas burner of the kind specified a gas burner head assembly comprising a cap-like upper member having a skirt and a top plate with an opening therein, and at least one insert plate adapted for mounting underneath said top plate so as to extend in parallel thereto and at a distance therefrom and having an integral boss for insertion into the opening of said top plate so that upon assembly ther is left a continuous annular slot either between the boss and said opening or between the boss and a concentric boss of another insert plate, which slot is to serve as gas delivery nozzle.

In accordance with one embodiment of a gas burner head assembly according to the invention the assembly comprises a single insert plate adapted for suspension from the inner wall of the cap-like upper member and having ports adapted for the passage of gas therethrough.

In accordance with another embodiment a gas burner head assembly according to the invention comprises a single insert plate adapted for mounting around a central post of the burner, the insert plate being of a smaller size than said cap-like upper member.

In accordance with yet another embodiment of a gas burner head assembly according to the invention the assembly comprises at least two concentric insert plates of a size smaller than that of said cap-like upper member the innermost plate being adapted for mounting around a central post of the burner, each of the second and any further insert plate having an annular boss adapted to be surrounded by the boss of the insert plate below at a distance therefrom so as to form an annular nozzle between the two and each of said second and any further insert plate being adapted to rest on the one below in spaced relationship.

By one modification of the foregoing embodiments said insert plate is adapted for suspension from the central post. By another modification it is adapted for mounting around the post in such a manner as to leave a tubular passageway between them.

Where in the foregoing embodiments the head assembly is designed for association with a tubular post accommodating an electric ignition device and the insert plate is adapted for suspension from the post, the insert plate comprises a central bore which in the assembled state is in alignment with tubular post.

BRIEF DESCRIPTION OF THE DRAWINGS

The invention will now be described by way of example only, with reference to the accompanying drawings in which.

DESCRIPTION OF THE PREFERRED EMBODIMENTS

Figure 1:
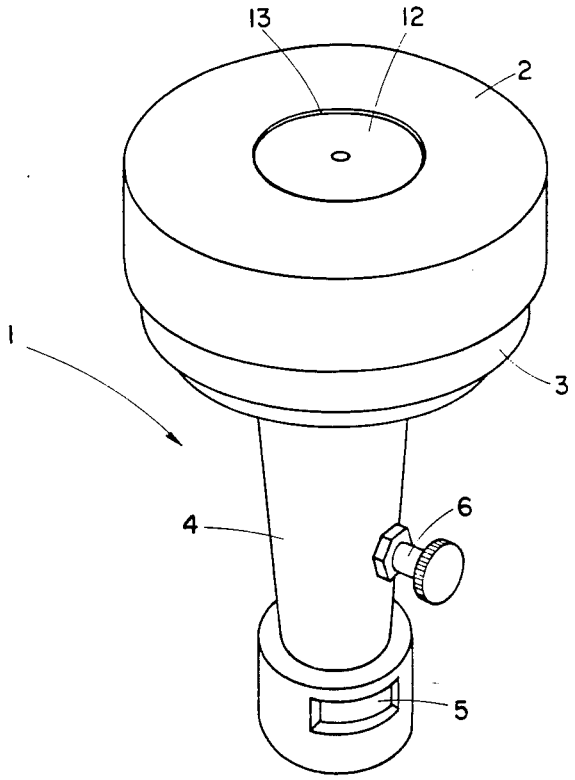
FIG. 1 is a perspective view of a gas burner according to the invention.

The burner 1 according to the invention shown in FIG. 1 comprises a cylindrical, cap-like upper member 2 resting on a cylindrical base member 3 integral with a vertical, coaxial, venturi-type tubular member 4 fitted with an opening 5 for the aspiration of air, and an adjustment valve 6. The tubular member 4 is adapted for coupling to a gas supply pipe. The space confined between the upper and base members 2 and 3 is the gas chamber.

Figure 3:
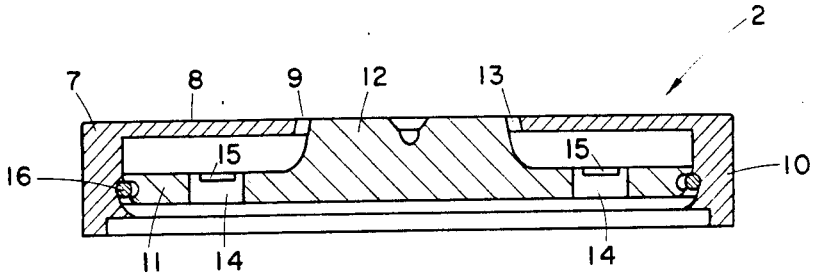
FIG. 3 is a section along lines III—III of FIG. 2.
Figure 2:
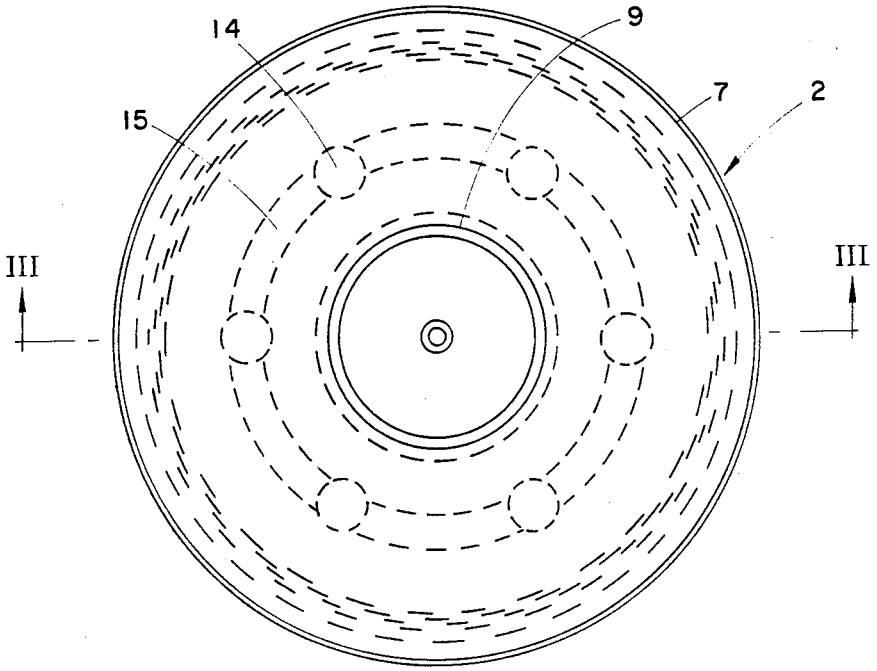
FIG. 2 is a plan view of the head of the burner of FIG. 1.
Figure 4:
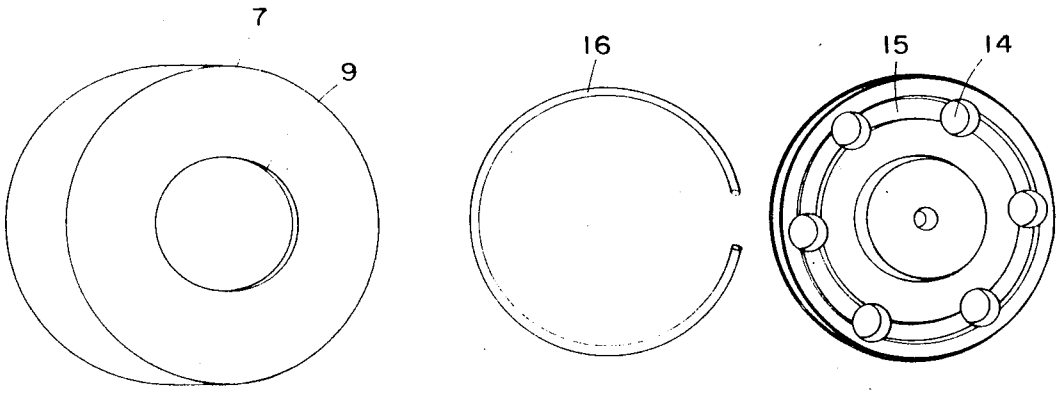
FIG. 4 is an exploded perspective view of the head assembly of the burner of FIG. 1.

The head assembly 2 is more closely shown in FIGS. 2–4. As shown it comprises a cylindrical, cap-like upper member 7 having a top plate 8 with a concentric hole 9. The cap-like upper member 7 further comprises a circumferential skirt 10 and from the inner side thereof there is suspended a circular insert plate 11 having an integral central boss 12 fitting into the opening 9 of cap member 7 so that an annular slot 13 is formed between boss 12 and the edge of hole 9 which serves as gas delivery nozzle.

Insert plate 11 comprises a plurality of ports 14 serving for the passage of gas therethrough. On the upper face of the insert plate 11 there is provided an annular recess 15 such that each segment thereof extends between two neighboring ports 14.

For the suspension of the insert plate 11 from the inner side of skirt 10 of the upper member 7, the rim of plate 11 and the skirt 10 are fitted with complementary circumferential grooves housing a resilient annular spring 16 which is in the form of a slit O-ring and is designed to hold plate 11 in position. However, by slight pressure on boss 12 the plate 11 may be detached from the upper member 7 and, likewise, plate 11 can be easily positioned by first mounting spring 16 on the rim of plate 11 and then positioning the plate. In this way the head member 2 can be readily assembled and taken apart.

The lower rim portion of skirt 10 is so designed as to fit on and engage in an essentially gas tight manner the upper rim of the dish-like base member 3 and in this way a gas chamber is formed between the two.

In operation a pressurized gas/air mixture is delivered from the venturi-type tubular member 4 into the gas chamber and passes through ports 14 into the annular space formed between top plate 8 of the upper member 7 and insert plate 11. Due to the annular recess 15 the gas inside the space distributes evenly and emerges in an even flow through the annular nozzle 13. The burning gas heats boss 12 and by conduction the entire insert plate 11 is also heated. Due to the direct contact between the gas/air mixture in the gas chamber and the insert plate 11, there occurs a direct heat transfer with the consequence that the gas delivered for combustion through the annular nozzle 13 is adequately preheated.

In operation, a vessel that is being heated will be at least co-extensive with top plate 8 and consequently the annular nozzle 13 is removed from the lower edge of the vessel. Furthermore, as is well known in the art, vessels to be heated in a gas stove are placed on supporting members such as a grill, ribs or the like which keep the vessel at only a slight distance from the gas burner head. It is thus easily understood that the above two facets of the operation of a burner according to the invention have the effect of not enabling a significant air flow from the ambient atmosphere to the flame burning at nozzle 13. In consequence, the composition of the gas/air mixture does not appreciably change upon ejection through the annular nozzle 13, which is a significant contribution to the effective utilization of the gas.

The cap-like upper member 7 has been illustrated and described hereinbefore as having a flat top plate 8. If desired, the top plate may also be bulging.

It is also readily understood that with a gas burner according to the invention the flame remains always confined to underneath the bottom of the vessel which is being heated and in this way heat losses are minimized and the utilization of the heat generated by the flame is significantly better than in the prior art gas burners.

It has been found in accordance with the present invention that in consequence of all the above improvements the time required for heating the contents of a vessel to boil with a gas burner according to the invention, is 20 to 30% shorter than with a conventional gas burner of similar caloric capacity. It is thus evident that in accordance with the present invention a significant saving of gas is achieved.

From the foregoing description it is also readily understood that even where the contents of the vessel that is being heated spills over, the spilt over matter will as a rule not reach the annular nozzle 13 so that even under such severe conditions the flame will continue to burn normally.

Figure 5:
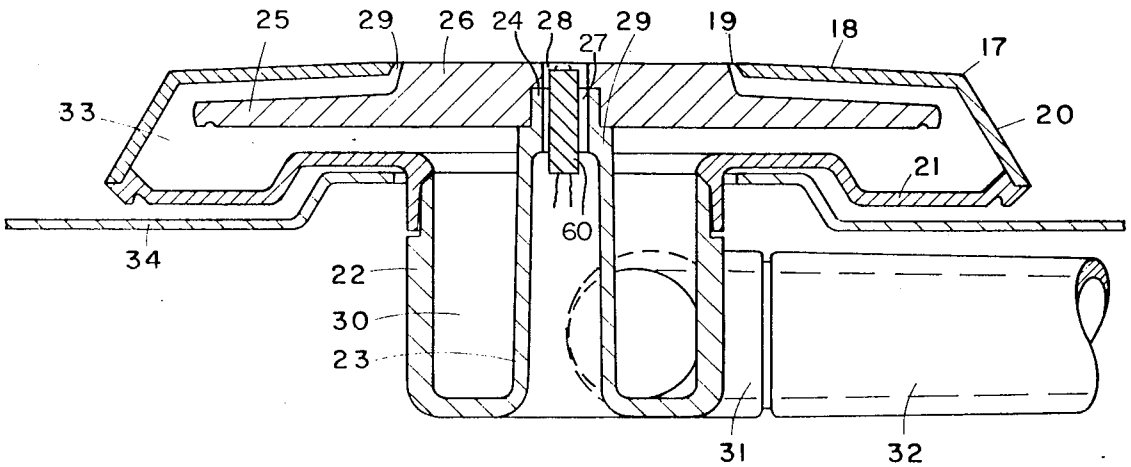
FIG. 5 is a vertical section of another embodiment of a gas burner according to the invention with one single insert plate.

The embodiment of a gas burner according to the invention shown in FIG. 5 comprises a frusto conical cap-like upper member 17 having a top plate 18 with a central hole 19 and a slanted skirt 20 resting on the rim portion of a circular dish-like base member 21 mounted on the rim portion of a cylindrical trough-like member 22 comprising a central tubular post 23 whose upper end portion 24 is stepped and serves for the mounting of an insert plate 25 by means of the integral boss 26 thereof. As shown plate 25 is smaller than cap-like member 17, an annular clearance being left between the two. End portions 24 comprises a central bore 27 and boss 26 comprises a central bore 28, bores 27 and 28 being aligned with each other and serve for the accommodation of an electric ignition device 60. The upper member 17 and the base member 21 confine between them a gas chamber 33.

Similar as in the embodiment of FIGS. 1-4 an annular nozzle 29 is formed between boss 26 and the top plate 18 of the upper member 17.

The cylindrical trough-like member 22 comprises a downward extending, vertical, axisymmetrical intake chamber 30 merging into gas chamber 33 and formed between the outer wall of member 22 and the tubular post 23. Chamber 30 is shown here to be tubular but other axisymmetrical shapes are conceivable. Associated with chamber 30 is a tangentially positioned gas delivery member whose tubular portion 31 outside cyindrical member 22 is coupled to a venturi type gas supply pipe 32 having an air intake (not shown) the assembly 31, 32 being adapted to deliver in tangential flow a gas/air mixture of a predetermined composition. The gas burner assembly is mounted on stove plate 33 in the manner shown.

In operation the gas/air mixture delivered by venturi pipe 32 is discharged radially into chamber 30 so as to swirl therein. From chamber 30 the swirling gas/air mixture is delivered to gas chamber 33 where it proceeds along a tortuous path comprising the clearance between the lower face of insert plate 25 and dish-like base member 21, the clearance between the edge of insert plate 25 and skirt 20 and the clearance between the upper face of insert plate 25 and the lower face of top plate 18, and is ejected through nozzle 29. Similar as in the embodiment described with reference to FIGS. 1-4, the burning flame heats boss 26 and insert plate 25 and consequently the gas flowing along the tortuous path as specified in contact with plate 25 is preheated.

Figure 6:
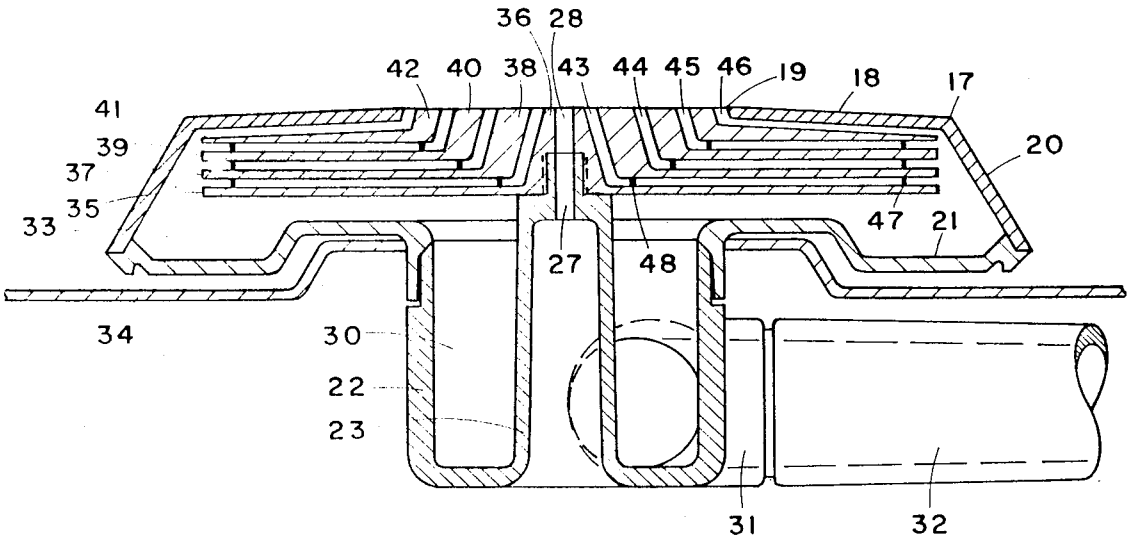
FIG. 6 is a vertical section of yet another embodiment of a gas burner according to the invention with a plurality of insert plates.

The embodiment of a gas burner according to the invention shown in FIG. 6 embodies the same design principle as that of FIG. 5 but in this case there are provided a plurality of insert plates. Similar parts in this embodiment are designated by the same reference numerals. As shown there are provided here four insert plates 35, 37, 39 and 41 having each an integral boss, which bosses are indicated respectively at 36, 38, 40 and 42. Bosses 38, 40 and 42 are in the form of sleeves, each sleeve surrounding the boss of the plate below. As shown, annular slots are left between each two consecutive bosses and between the outermost boss 42 and the edge of hole 19 so that there are formed altogether four concentric annular nozzles 43, 44, 45 and 46. Spacer elements such as 47 and 48 are provided between consecutive insert plates in order to maintain the distances between them.

In the embodiment of FIG. 6, four different tortuous passages are formed inside the gas chamber 33, each passage being in principle of a similar design as the tortuous passage described with reference to FIG. 5 and during operation four concentric flames are formed at the four nozzles 43, 44, 45 and 46.

Figure 7:
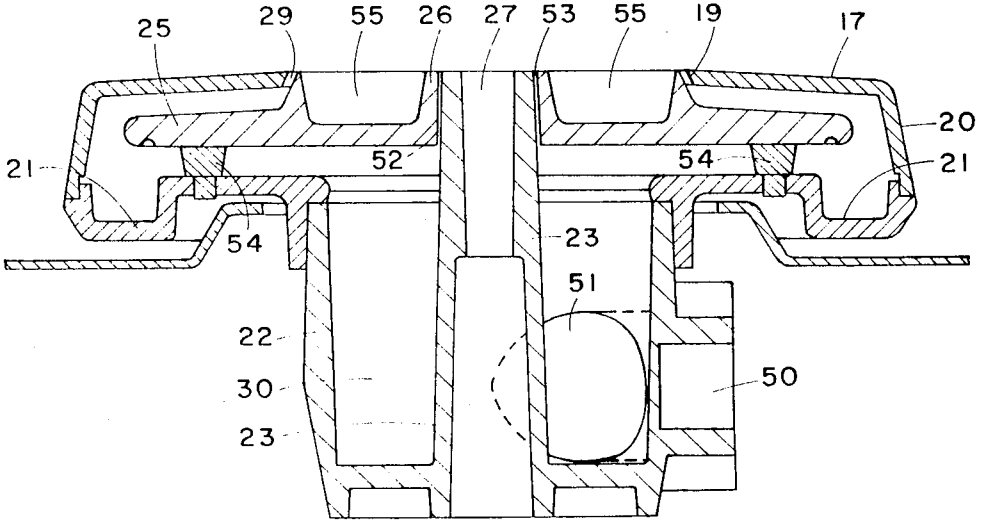
FIG. 7 is a vertical section of yet another embodiment of a gas burner according to the invention with a single insert plate.

The embodiment of a gas burner according to the invention shown in FIG. 7 embodies the same design principle as that of FIG. 5 but in this case the insert plate is mounted around the centre post in such a way as to leave a tubular passageway between them, means being provided for supporting the insert plate on said base member. Similar parts in this embodiment are again designated by the same reference numerals as in FIG. 5. As shown, the cylindrical member 22 comprises a socket 50 for receiving the delivery end portion of a venturi type tube (not shown). From socket 50 a passageway (not shown leads to an injector head 51 adapted to inject the gas/air mixture delivered by the venturi tube into intake chamber 30 in a tangential flow.

The central boss 26 of insert plate 25 has a tubular bore 52 of a somewhat larger diameter than that of the central post 23 so that a tubular passageway 53 is left between the two. Insert plate 25 rests on base member 21 by means of a number of integral bosses 54 which are of such a number and size as essentially not to interfere with the tortuous flow of the gas/air mixture in the gas chamber.

At its top face insert plate 25 comprises an annular groove 55 whereby its heat dissipating surface is increased.

As in the embodiment of FIGS. 5 and 6, the central bore 27 of post 23 is adapted to accommodate an electric ignition device.

The tubular passageway 53 serves as an additional, innermost annular nozzle which contributes to the normal operation of the burner head and is furthermore instrumental during ignition in that the gas/air mixture delivered therethrough immediately catches fire from a spark produced by the electric ignition device and the resulting flame spreads radially so as to ignite the gas/air mixture delivered through the annular nozzle 29.

The annular groove 55 increases the rate of heat dissipation from insert plate 25 which increases the efficiency of the burner head, and is also instrumental in avoiding any overheating of insert plate 25.

I claim:

1. A gas burner having a head assembly comprising:

a cap-like upper member having a skirt and a top plate with a port therethrough;

a dish-like base member supporting said upper member;

a gas chamber confined between said upper and base members;

a first insert plate inside the gas chamber extending substantially parallel to and at a distance from the top plate of said upper member wherein said top plate and insert plate are in substantial overlapping relationship to each other, said insert plate having an integral boss extending into the port at the top plate of said upper member so as to form a continuous annular slot serving as a gas delivery nozzle;

means for supplying a gas/air mixture into said gas chamber; and means for conducting the gas/air mixture to said continuous annular slot, and in contact with said first insert plate, whereby said gas/air mixture is preheated.

2. A gas burner according to claim 1, wherein said cap-like upper member and dish-like base member are substantially circular.

3. A gas burner according to claim 1 wherein said first insert plate is detachably supported on an inner wall of the cap-like upper member and comprises ports for the passage of gas therethrough.

4. A gas burner having a head assembly comprising:

a cap-like upper member having a skirt and a top plate with an opening therein;

a dish-like base member supporting said upper member;

a gas chamber confined between said upper and base members;

a first insert plate inside the gas chamber extending substantially parallel to and at a distance from the top plate of said upper member and having an integral boss extending into the opening in the top plate of said upper member so as to form a continuous annular slot serving as a gas delivery nozzle;

means for supplying a gas/air mixture into said gas chamber; and a central post, with said first insert plate being detachably mounted around said post and being of a smaller size than said cap-like upper member;

whereby a rim of said plate remains clear of the upper member thereby to form inside the gas chamber a tortuous passageway for the gas/air mixture arriving from said gas supply means.

5. A gas burner having a head assembly comprising;

a cap-like upper member having a skirt and a top plate with an opening therein;

a dish-like base member supporting said upper member;

a gas chamber confined between said upper and base members;

a first insert plate inside the gas chamber extending substantially parallel to and at a distance from the top plate of said upper member and having an integral boss extending into the opening in the top plate of said upper member so as to form a continuous annular slot serving as a gas delivery nozzle;

means for supplying a gas/air mixture into said gas chamber; and a central post and at least two substantially concentric insert plates including said first plate and an innermost plate which is detachably mounted around said post, all of said insert plates being of smaller size than said cap-like upper member, whereby the rims of all said insert plates remain clear of the upper member thereby to form inside the gas chamber a tortuous passageway for the gas/air mixture arriving from said gas supply means, said first plate and any intermediate insert plate having an annular boss adapted to surround a boss of a next inner insert plate at a distance therefrom so as to form an annular nozzle between two adjacent insert plates, whereby a plurality of concentric annular nozzles is formed, said first plate and an intermediate insert plate resting on the next inner insert plate, with spacer means being provided for keeping the individual insert plates spaced from each other.

6. A gas burner according to claim 4, wherein said post is tubular and accommodates an electric ignition device.

7. A gas burner according to claim 5, wherein said insert post is tubular and accommodates an electric ignition device.

8. A gas burner according to claim 4, wherein said insert plate mounted around said post is supported thereon.

9. A gas burner according to claim 5, wherein said insert plate mounted around said post is supported thereon.

10. A gas burner according to claim 4, wherein said first insert plate comprises a port therethrough, and additionally comprising, means for supporting said first insert plate on said base member in such a manner as to leave a tubular passageway between said post and first insert plate.

11. A gas burner having a head assembly comprising:

a cap-like upper member having a skirt and a top plate with an opening therein;

a dish-like base member supportng said upper member;

a gas chamber confined between said upper and base members;

a first insert plate inside the gas chamber extending substantially parallel to and at a distance from the top plate of said upper member and having an integral boss extending into the opening in the top plate of said upper member so as to form a continuous annular slot serving as a gas delivery nozzle; and means for supplying a gas/air mixture into said gas chamber, wherein said means for supplying a gas/air mixture into the gas chamber comprise a tubular intake chamber substantially coaxial with said gas chamber, and pipe means for delivering the gas/air mixture into said intake chamber in substantially tangential flow.

12. For use in a gas burner, a gas burner head assembly characterized in that it comprises a cap-like upper member having a skirt and a top plate with a port therethrough, and a first insert plate adapted for mounting underneath said top plate so as to extend substantially parallel thereto and at a distance therefrom wherein said top plate and insert plate are in substantial overlapping relationship to each other, said insert plate having an integral boss for insertion into the port of said top plate so that upon assembly there is left a continuous annular slot, which slot is to serve as a gas delivery nozzle.

13. A gas burner head assembly according to claim 12, wherein said first insert plate is adapted for support on an inner wall of the cap-like upper member and comprises ports adapted for the passage of gas therethrough.

14. A gas burner assembly according to claim 12, wherein said first insert plate is adapted for mounting around a central post of the burner, the first insert plate being of a smaller size than said cap-like upper member.

15. A gas burner head assembly for use in a gas burner, characterized in that it comprises a cap-like upper member having a skirt and a top plate with an opening therein, and a first insert plate adapted for mounting underneath said top plate so as to extend substantially parallel thereto and at a distance therefrom and having an integral boss for insertion into the opening of said top plate so that upon assembly there is left a continuous annular slot, which slot is to serve as a gas delivery nozzle, comprising at least two substantially concentric insert plates of a size smaller than that of said cap-like upper member, including said first insert plate and an innermost plate being adapted for mounting around a central post of the burner, said first plate and any intermediate insert plate having an annular boss adapted to surround a boss of a next inner insert plate at a distance therefrom so as to form an annular nozzle between two adjacent insert plates, and said first insert plate and any intermediate insert plate being adapted to rest on the next inner insert plate in spaced relationship.

16. A gas burner head assembly according to claim 15, wherein said innermost plate is adapted for support on the central post.

17. A gas burner head assembly for use in a gas burner, characterized in that it comprises a cap-like upper member having a skirt and a top plate with an opening therein, and a first insert plate adapted for mounting underneath said top plate so as to extend substantially parallel thereto and at a distance therefrom and having an integral boss for insertion into the opening of said top plate so that upon assembly there is left a continuous annular slot, which slot is to serve as a gas delivery nozzle, wherein said first insert plate is adapted for mounting around a central post of the burner, the first insert plate being of a smaller size than said cap-like upper member, and wherein said first insert plate is adapted for support on the central post.

18. A gas burner head assembly for use in a gas burner, characterized in that it comprises a cap-like upper member having a skirt and a top plate with an opening therein, and a first insert plate adapted for mounting underneath said top plate so as to extend substantially parallel thereto and at a distance therefrom and having an integral boss for insertion into the opening of said top plate so that upon assembly there is left a continuous annular slot, which slot is to serve as a gas delivery nozzle, wherein said first insert plate is adapted for mounting around a central post of the burner, the first insert plate being of a smaller size than said cap-like upper member, wherein said first insert plate comprises a port therethrough, and additionally comprising means for mounting said first insert plate around said post in such a manner as to leave a tubular passageway therebetween.

19. A gas burner according to claim 1, wherein one or more of said burners are provided in combination with a gas stove.

20. The assembly of claim 18, wherein said first insert plate comprises an annular groove extending around a top thereof between said passageway and said continuous annular slot.

* * * * *